US011692365B2

(12) United States Patent
Huang et al.

(10) Patent No.: US 11,692,365 B2
(45) **Date of Patent: *Jul. 4, 2023**

(54) FRAME POOL

(71) Applicant: BESTWAY INFLATABLES & MATERIAL CORP., Shanghai (CN)

(72) Inventors: Shuiyong Huang, Shanghai (CN); Chun Yang, Shanghai (CN); Zhongxiong Zhu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/402,115

(22) Filed: Aug. 13, 2021

(65) Prior Publication Data

US 2021/0372153 A1 Dec. 2, 2021

Related U.S. Application Data

(63) Continuation of application No. 16/368,829, filed on Mar. 28, 2019, now Pat. No. 11,111,682.

(30) Foreign Application Priority Data

Mar. 29, 2018 (CN) ..... 201820438045.0

(51) Int. Cl.
*E04H 4/00* (2006.01)
*E04H 4/14* (2006.01)

(52) U.S. Cl.
CPC ..... *E04H 4/0056* (2013.01); *E04H 2004/146* (2013.01)

(58) Field of Classification Search
CPC ..... E04H 4/0056; E04H 2004/146
USPC ..... 4/506, 513
See application file for complete search history.

(56) References Cited

U.S. PATENT DOCUMENTS

| | | | | |
|---|---|---|---|---|
| 5,083,327 | A * | 1/1992 | Gillebaard | E04H 4/0056 4/506 |
| 11,111,682 | B2 * | 9/2021 | Huang | E04H 4/0056 |
| 2017/0089085 | A1 * | 3/2017 | Liu | E04H 4/0056 |
| 2017/0356206 | A1 * | 12/2017 | Huang | E04H 4/0056 |

FOREIGN PATENT DOCUMENTS

| | | | | |
|---|---|---|---|---|
| FR | 2672330 | A1 * | 8/1992 | E04H 4/0056 |
| FR | 2732711 | A1 * | 10/1996 | E04H 4/0056 |

* cited by examiner

*Primary Examiner* — Tuan N Nguyen
(74) *Attorney, Agent, or Firm* — Dickinson Wright PLLC

(57) ABSTRACT

A frame pool includes a pool body having a space for containing liquid and a support frame for supporting the pool body. The pool body has an upper edge with a sleeve. The support frame includes an upper frame extending through the sleeve and a plurality of support members holding the upper frame in an elevated position. The upper frame includes first upper tubes, second upper tubes, and connecting tubes connecting the first upper tubes to the second upper tubes. Collars are provided within assembling ends of the first and second upper tubes. Each end of each of the connecting tubes is movably inserted into a collar located within an assembling end of a corresponding one of the upper tubes. Anti-rust coatings on the outer surfaces of the connecting tubes can be prevented from being worn and water can be sealed out of the tubes of the upper frame.

15 Claims, 5 Drawing Sheets

FRAME POOL

CROSS REFERENCE TO RELATED APPLICATION

This application is a continuation of and claims priority to U.S. patent application Ser. No. 16/368,829, filed Mar. 28, 2019, which claims priority to Chinese patent application No. CN 201820438045.0, filed Mar. 29, 2018, the contents of which are hereby incorporated by reference in their entirety.

TECHNICAL FIELD

The present disclosure relates to an above-ground pool, and more particularly, to a frame pool with a collar.

BACKGROUND

There are various types of above-ground pools. One type of above-ground pool is a pool that includes a frame (also referred to as a supporting portion) with a ring-shaped upper portion configured as a closed ring of tubes connected with each other and a pool body made of flexible water-tight material. The tubes in conventional frame pools may be made of metal. The upper portion of the metal frame includes upper tubes. The pool body includes a pool wall with an upper edge that is hung from the upper tubes.

Conventional frame pools include a supporting portion having upper tubes, L-shaped connecting tubes and support members. One conventional frame pool configuration has a rectangular shape in which the pool has two opposite long sides and two opposite shorter sides, and the supporting portion includes four L-shaped connecting tubes on the corners of the frame. The upper tubes are disposed within the two opposing long sides and the two opposing shorter sides. The two ends of the L-shaped connecting tubes are respectively coupled to adjacent upper tubes to form the ring-shaped upper portion of the frame. The support members may be connected to the upper tubes located at the shorter sides and the long sides of the pool by insertion therein.

In order to prevent the metal portions of the frame from being exposed and oxidized, the outer surfaces of the tube bodies may be coated with an anti-rust coating, such as anti-rust paint and/or an epoxy coating. Therefore, the inner surfaces of the upper tubes may be much rougher than the outer surfaces thereof. The outer surfaces of the L-shaped connecting tubes may directly contact and rub against the inner surfaces of the upper tubes. Therefore, the anti-rust coatings on the outer surfaces of the L-shaped connecting tubes may be quickly worn and oxidized. Furthermore, large gaps may extend between the ends of each of the L-shaped connecting tubes and the walls of their corresponding upper tubes, which can allow water to enter the upper tubes, also resulting in oxidation. In addition, some conventional frame pools include fitting holes, which may also be called through-holes, in the upper tube. Water can easily enter the interior of the tube bodies through these fitting holes, thereby accelerating corrosion of the metal tubes.

SUMMARY

The present disclosure provides a frame pool having one or more collars configured to address and improve upon technical problems in conventional frame pools, such as those described above.

The frame pool of the present disclosure may comprise a pool body defining a space adapted to contain liquid and a support frame adapted to support the pool body. The pool body includes a sleeve extending along an upper edge thereof. The support frame may comprise an upper frame and a plurality of support members adapted to support the upper frame in an elevated position. The upper frame includes a first upper tube, a second upper tube, and a connecting tube coupling the first upper tube to the second upper tube. The upper frame extends through the sleeve at the upper edge of the pool body. A collar having a generally tubular shape is coupled between the connecting tube and one of the first and second upper tubes, with the connecting tube free to move in an axial direction relative to the one of the first and the second upper tubes.

In accordance with various embodiments, an end of the connecting tube may extend through the collar and into one of the upper tubes with the collar disposed around the connecting tube to hold the upper tube outwardly from the connecting tube. The collar, therefore, may cover a portion of an inner surface of the one of the upper tubes. Thereby, direct contact and friction between outer surfaces of the connecting tube and the inner surfaces of the upper tubes can be reduced or avoided. Coatings, such as an anti-rust coating, on any or all of those surfaces can be protected from wear that could otherwise result from direct contact therebetween. Moreover, gaps between the inner surfaces of the upper tubes and the outer surfaces of the connecting tubes are reduced by the wall of the collar, which can reduce or prevent water from intruding into the upper tubes.

In accordance with various embodiments, the first upper tube may extend perpendicularly to the second upper tube. In some embodiments, one of the first and second upper tubes is attached to the collar by a coupling. In some embodiments, one of the first and second upper tubes defines an assembling end having a tubular shape configured to receive the collar, and the coupling includes a protrusion on an inner surface of the assembling end and a recess on an outer surface of the collar, with the protrusion adapted to extend into the recess to connect the corresponding one of the first and second upper tubes to the collar.

In some embodiments, the frame pool includes a first water-tight seal disposed between the collar and one of the upper tubes. Specifically, each of the first water-tight seals comprises an outer flange extending radially outwardly from an outer surface of the collar and located adjacent to an end of the collar. The upper tube connected to the collar defines a rim at an end thereof. The outer flange abuts against the rim of a corresponding one of the first and second upper tubes to seal a gap between the outer surface of the collar and the inner surface of the one of the first and second upper tubes. Thereby, water can be prevented from entering the tube bodies of the upper tubes via the gap. In some embodiments, the first water-tight seal further comprises a flexible ring provided between the outer flange of the collar and the rim of the corresponding one of the first and second upper tubes.

In some embodiments, a second water-tight seal is provided between the collar and the corresponding ones of the connecting tubes. Specifically, the second water-tight seal comprises an inner flange, and the inner flange extending radially inwardly from an inner surface of the collar. The inner flange abuts against an outer surface of a corresponding one of the connecting tubes to seal the gap between the inner surface of the collar and the outer surface of the corresponding one of the connecting tubes. Thereby, water can be prevented from entering the tube bodies of the upper tubes via the gap.

In some embodiments, a friction element extends from an outer surface of the collar towards one of the upper tubes surrounding the collar. The friction element may inhibit the collar from sliding axially relative to the one of the one of the first and second upper tubes. Specifically, the friction element may comprise one or more ribs extending annularly about the outer surface of the collar.

In some embodiments, one of the first or the second upper tubes includes a solid tubular wall overlapping the collar, with the solid tubular wall of the one of the first or the second upper tubes having no through-hole. In some embodiments, the collar may include a solid tubular wall having no through-holes. Thereby, flow of water into the tube bodies via through-holes on the walls of either or both of the collar and/or the upper tubes can be reduced or further prevented.

In various embodiments, the collar may be made of plastic. The connecting tubes may be configured to be L-shaped. The angle between the support members and the horizontal plane ranges from 45 degrees to 90 degrees. In various embodiments, the cross sections of the first upper tubes, the second upper tubes, the connecting tubes and the support members have one or more of the following shapes: circular shape, elliptic shape, athletic-track shape and square shape. The first upper tubes, the second upper tubes, the connecting tubes, and the support members may be made of metal. In some embodiments, a groove extends longitudinal direction on an outer surface of the collar.

The frame pool of the present disclosure may provide several advantages when compared to conventional frame pool designs. For example, the collar may reduce wear of anti-rust coating on the outer surfaces of the connecting tubes when the assembled ends of the connecting tubes move relative to one or more of the upper tubes. The frame pool of the present disclosure may also prevent flow of water into the tube bodies of the upper tubes by sealing and/or reducing gaps between the upper tubes and the connecting tubes. The flanges of the collar in some embodiments of the frame pool of the present disclosure may also prevent water from entering the tube bodies of the upper tubes through the gaps between the upper tubes and the connecting tubes. In some embodiments of the present disclosure, the walls of the upper tubes and the collar have no through-hole, thereby prevent water from entering the tube bodies via the through-holes on the walls, further protecting the frame pool from rust and/or other negative effects of water intrusion.

When the frame pool is filled with water, the pool frame may be shaken due to the sloshing of the water during use. In order to avoid stress concentration at the connections where the upper tubes are connected to the connecting tubes and prevent damage to one or more of the upper tubes and/or the connecting tubes, the connecting tubes may be axially movable relative to one or more adjacent upper tubes rather than fixedly connected to the adjacent upper tubes.

BRIEF DESCRIPTION OF THE DRAWINGS

To understand the present disclosure, it will now be described by way of example, with reference to the accompanying drawings in which implementations of the disclosure are illustrated and, together with the description below, serve to explain the principles of the disclosure.

DETAILED DESCRIPTION

The present disclosure provides exemplary embodiments of a frame pool. The exemplary embodiments of the present disclosure are described below with reference to the drawings for illustration. It should be understood that the description about the exemplary embodiments should be considered as mere illustrations of the structure and the principles of the frame pool, and the invention of the present disclosure is not limited to the exemplary embodiments.

Figure 1:
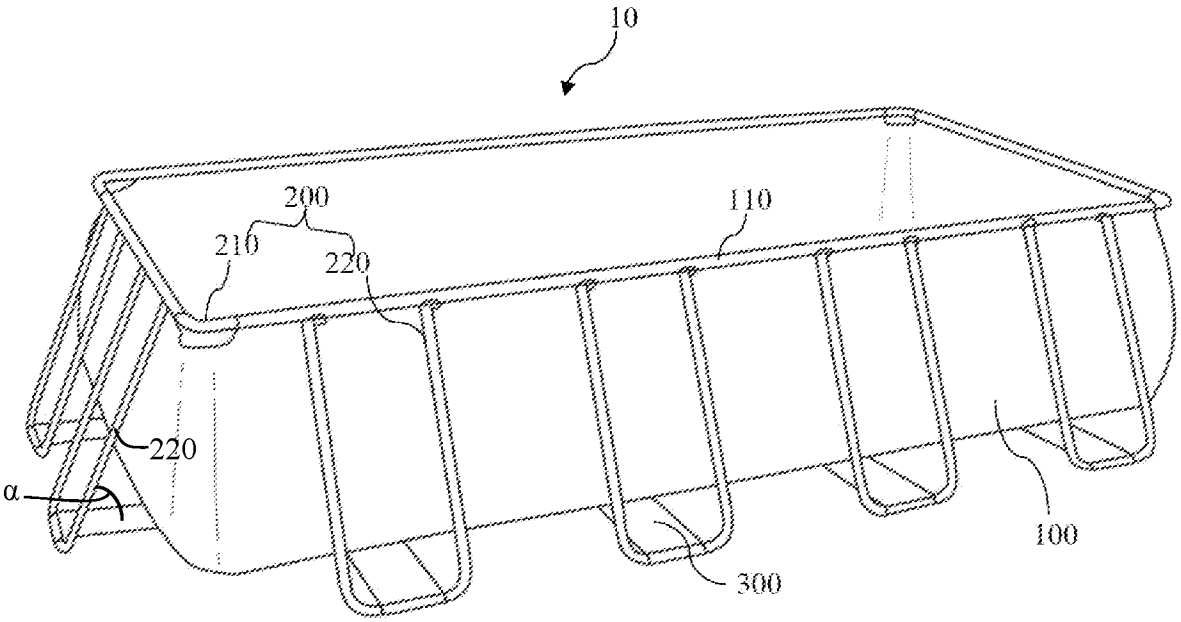
FIG. 1 is a perspective view of a frame pool, according to an embodiment of the present disclosure.

The frame pool 10 may include at least a pool body 100 and a support frame 200, as shown in FIG. 1. The pool body 100 defines a space for containing liquid (e.g., water or any other desired liquid). For example, the pool body 100 may be made of a flexible water-proof membrane or a flexible tarpaulin or any other desired flexible material. A sleeve 110 extends along an upper edge of the pool body 100. The support frame 200 may include an upper frame 210 and a plurality of support members 220 for supporting the upper frame 210, and the upper frame 210 is inserted into the sleeve 110 located at the upper edge of the pool body 100, thereby supporting the pool body 100. In some embodiments, the support members 220 may be U-shaped tubes. However, it should be understood by those skilled in the art that the present disclosure is not limited thereto and the support members may have any suitable shape. Moreover, the number of the support members 220 may not be limited to the number shown. Any number of support members may be employed, as long as they can stably support the upper frame 210 and the pool body 100. For example, each of two opposite sides of the upper frame 210 may be provided with a large U-shaped support member. That is, two support members may be employed to stably support the upper frame 210. In some embodiments, the bottoms of opposing U-shaped support members, which are symmetrical with each other, are connected by a strap 300 to further stabilize the support frame 200. Alternatively, the strap 300 may be omitted, or the strap 300 may be replaced with other connecting members such as rope, chain, cable, and/or string or any other desired connecting member. As also shown in FIG. 1, one or more of the support members 220 may define an angle $\alpha$ with a horizontal plane, such as the ground, which may allow the upper frame 210 to be stably supported. In some embodiments, the angle $\alpha$ between the support member 220 and the horizontal plane may range from 45 degrees to 90 degrees or any other desired range.

Figure 2:
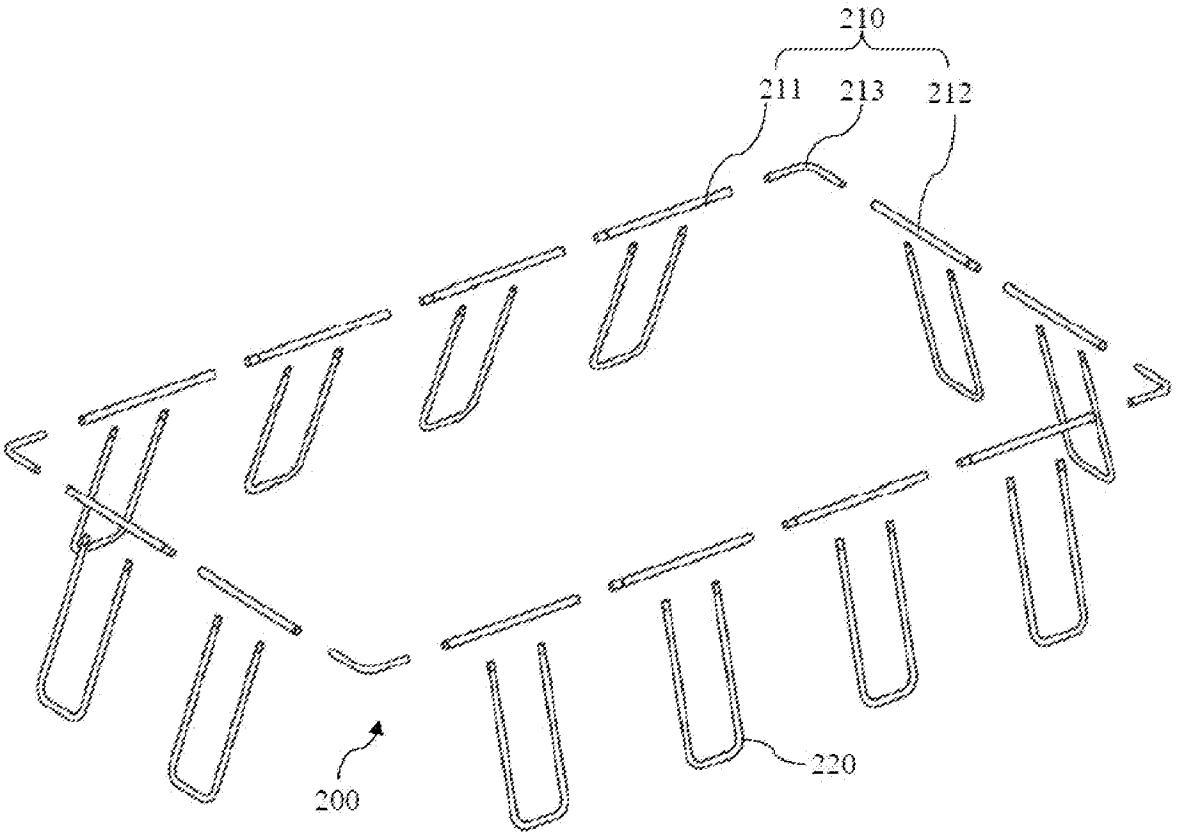
FIG. 2 is an exploded perspective view of the support frame of the frame pool shown in FIG. 1.

As shown in FIG. 2, the support frame 200 includes a plurality of support members 220 and an upper frame 210. The upper frame 210 may include a plurality of first upper tubes 211, a plurality of second upper tubes 212, and a plurality of connecting tubes 213. The support members 220 support the first upper tubes 211 and the second upper tubes 212. For example, the ends of the support members 220 may be provided with inverted V-shaped elastic pins (or any other desired shape or material for a connector). The inverted V-shaped elastic pins can be inserted into holes on the upper tubes 211, 212 and then restored such that the support members 220 are fixedly connected to the upper tubes 211, 212. Alternatively, the support members 220 may support only the first upper tubes 211 or the second upper tubes 212. For example, support members 220 may be used only on opposing lengthwise or widthwise sides of the upper frame 210 in some embodiments. The first upper tubes 211 and the second upper tubes 212 may be disposed to be perpendicular to each other. The first upper tube 211 and the second upper tube 212 adjacent to each other are connected by the connecting tube 213. In other words, the upper frame 210 may be rectangle-shaped. That is, the frame pool may be a rectangular pool. At a corner of the rectangular upper frame 210, an L-shaped, right angled tube may be employed as the connecting tube 213 to connect the first upper tube 211 in the length direction and the second upper tube 212 in the width direction. However, the present disclosure is not limited thereto, and the upper frame 210 may have other shapes to form a frame pool in other shapes. For example, the first upper tubes 211, the second upper tubes 212, and the connecting tubes 213 may be appropriately varied to form an upper frame 210 having other shapes, such as, for example, a polygon, an ellipse, or a circle thereby forming a polygonal pool or an elliptic pool or a circular pool when viewed from above.

In some embodiments, the first upper tubes 211, the second upper tubes 212, the connecting tubes 213 and/or the support members 220 may be made of metal. One or more of the first upper tubes 211, the second upper tubes 212, the connecting tubes 213 and the support members 220 may have a cross section with one or more of the following cross-sectional configurations: circular shape, elliptical shape, athletic-track shape, square shape or any other desired shape. An elliptical, or oval shape, may have a continuous curvature, and an athletic-track shape may have curved ends connecting each of two opposing straight sides that are parallel and spaced-apart from one-another. The outer surface of any or all of the tube bodies may be coated with any desired anti-rust coating to prevent the tube bodies from being oxidized (i.e., rusted) during use and throughout a prolonged service life of the product. In particular, the anti-rust coating may include an epoxy layer and/or anti-rust paint or any other desired anti-rust coating.

Figure 3:
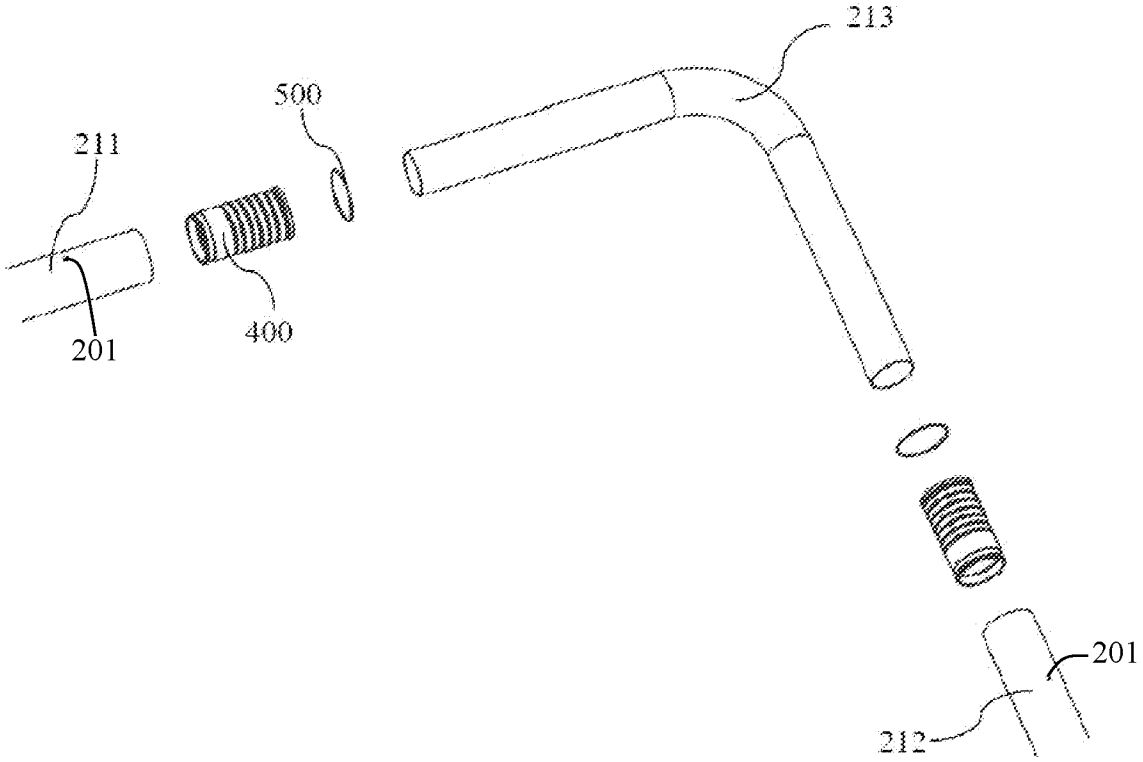
FIG. 3 is an exploded perspective view showing upper tubes, a connecting tube, and collars located at a corner of the upper frame of the support frame.
Figure 5:
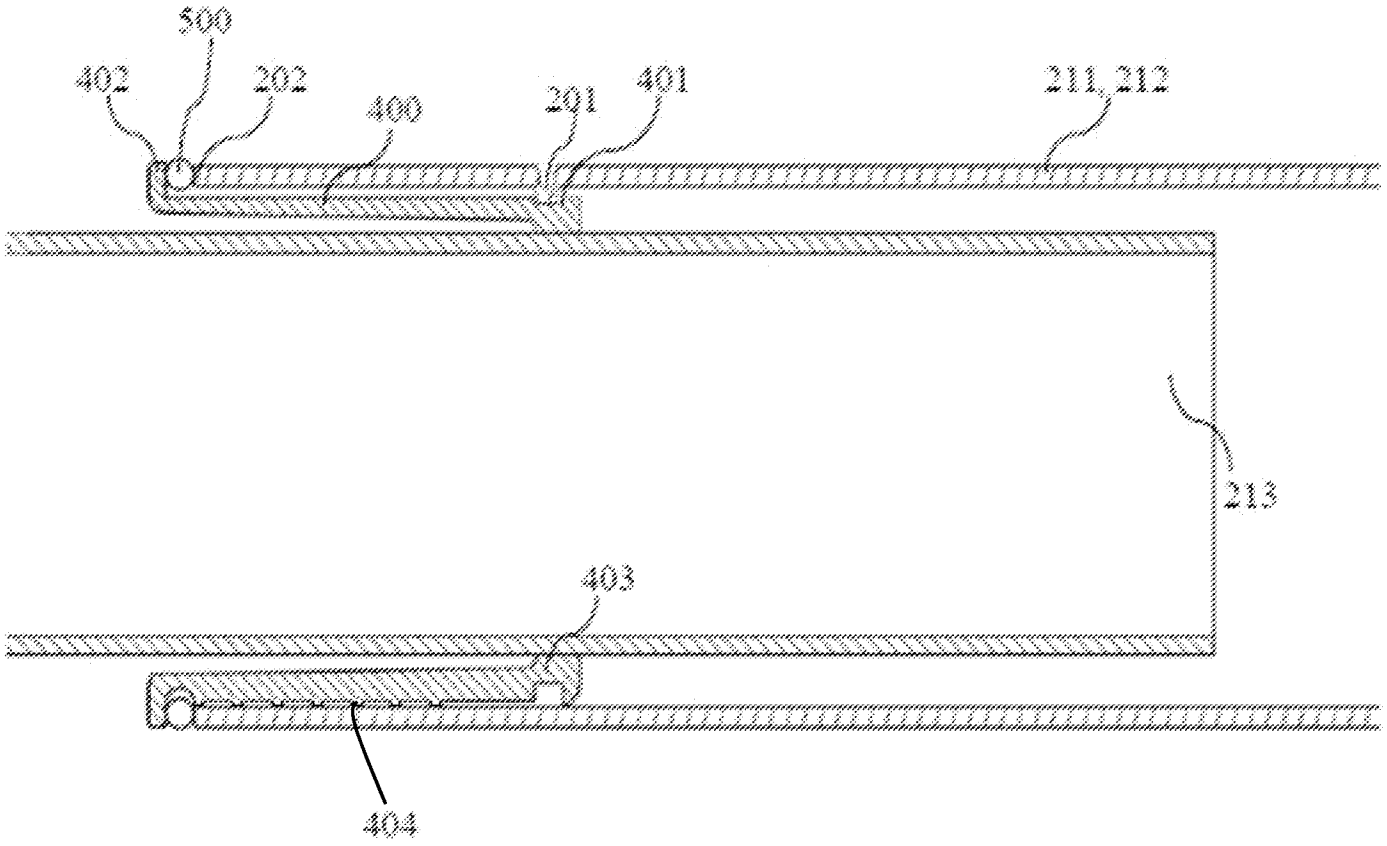
FIG. 5 is a cross-sectional view showing the connection relationship among the upper tube, the connecting tube, and the collar at a corner of the upper frame of the support frame.

In some embodiments, and as shown by way of example in FIGS. 3 and 5, the ends of the first upper tube 211 and the second upper tube 212 for assembly with the connecting tube 213 are referred to as assembling ends. Collars 400 are disposed within the assembling ends of the first upper tube 211 and the second upper tube 212 to prevent the anti-rust coating on the corresponding ends of the connecting tube 213 from being worn. The connecting tube 213 is movably inserted into the collars 400. In other words, the connecting tube 213 is inserted into a collar 400 (i.e., one collar 400 on each end of a connecting tube 213) and is movable within the collar 400. Thus, when the pool frame moves or is shaken due to the sloshing of water in the pool or from any other driving force, stress concentration at the connections where the upper tubes are connected to the connecting tube can be reduced, if not altogether avoided. Specifically, the collar 400 disposed at the first upper tube 211 covers a portion of the inner surface of the first upper tube 211, and the collar 400 disposed at the second upper tube 212 covers a portion of the inner surface of the second upper tube 212. One end of the connecting tube 213 is movably inserted into the collar 400 disposed at the assembling end of the first upper tube 211, and the other end of the connecting tube 213 is movably inserted into the collar 400 disposed at the assembling end of the second upper tube 212. Undesired friction that would otherwise exist (e.g., in frame pools not including the features of the present invention) between the outer surfaces of the connecting tube and the inner surfaces of the upper tubes can be avoided by use of the collars 400, thus preventing the anti-rust coating on the connecting tube from being worn. In some embodiments, the collars 400 may be made of plastic (such as Acrylonitrile Butadiene Styrene (ABS), Polyoxymethylene (POM) or any other desired plastic material). The collars 400 may have flat and smooth inner surfaces such that the friction between the connecting tube 213 and the collars 400 can be further reduced. In some embodiments of the present disclosure, a flexible ring 500, such as a rubber ring (or any other desired material ring), is provided between the collar 400 and the rim of the upper tube 211, 212 at the assembling end.

Figure 4:
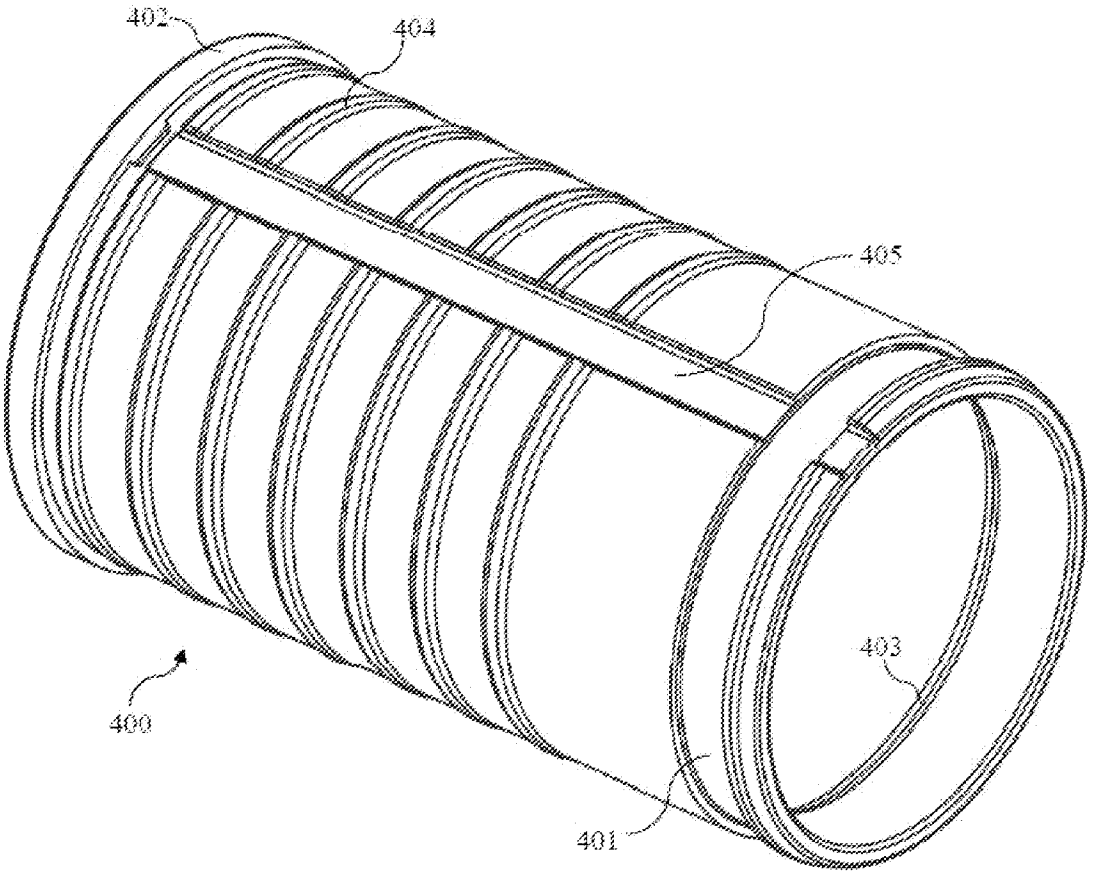
FIG. 4 is an enlarged perspective view of the collar of the frame pool, according to various embodiments of the present disclosure.

As shown in FIG. 4, the outer surface of the collar 400 may be provided with a recess 401, an outer flange 402, a plurality of ribs 404, and a groove 405. The inner surface of the collar 400 may be provided with an inner flange 403. The plurality of ribs 404 are provided in circumferential orientation on the outer surface of the collar 400 to constitute an friction element between the collar 400 and the corresponding upper tube 211, 212, so that the collar 400 can be stably connected to the upper tube 211, 212 and be prevented from slipping out of the upper tube 211, 212 during assembly or use. The collar 400 may include any number of the ribs 404. The groove 405 is provided in the longitudinal direction on the outer surface of the collar 400. The groove 405 extends through the plurality of ribs 404, and corresponds to a weld that may protrude from the inner surface of the first upper tube 211 or the second upper tube 212. In other words, a protruding weld can be received in the groove 405 to avoid friction between the weld and the outer surface of the collar 400 and to protect the collar 400 from being damaged.

FIG. 5 is a cross-sectional view taken along the weld (and the groove 405) showing the connection relationship among the upper tube 211 or 212, the connecting tube 213, and the collar 400. As shown in FIG. 5, the collar 400 is disposed in the upper tube 211 or 212 and located at the assembling end thereof, and the connecting tube 213, having an outer diameter smaller than an inner diameter of the upper tubes 211 and 212 and smaller than the inner diameter of the collar 400, is movably inserted into the collar 400, disposed within the upper tube 211 or 212. The inner surface of the upper tube 211 or 212 is provided with a protrusion 201 corresponding to the ring-shaped recess 401 of the collar 400. For example, a portion of the wall of the upper tube may be inwardly recessed to form the protrusion 201 extending from the inner surface thereof. The protrusion 201 is mated with the recess 401 to connect the upper tube 211 or 212 to the corresponding collar 400. In other words, the recess 401 and the protrusion 201 constitute a coupling for connecting the first upper tube 211 or the second upper tube 212 to the corresponding collar 400. However, this is merely an example of the coupling that may be employed, and so therefore, other suitable connection structures may employed in lieu of or in addition to the above-described coupling technique. In some embodiments, the frame pool 10 of the present disclosure may include one or more connections between the connecting tube 213 and one of the upper tubes 211, 212 that is different from the connection arrangement shown in FIG. 5. For example, one of the upper tubes 211, 212 may extend into the connecting tube 213, with the collar 400 disposed therebetween.

In some embodiments, as shown in FIG. 5, a ring-shaped outer flange 402 of the collar 400 is provided on the outer surface of the collar 400 and located at an end of the collar 400. A flexible ring 500 is provided between the outer flange 402 and the rim 202 to seal the gap between the outer surface of the collar 400 and the inner surface of the corresponding upper tube 211, 212. The outer flange 402, the rim 202 and the flexible ring 500 may constitute a first water-tight seal to prevent water from entering the interior of either of the upper tubes 211, 212 via the gap between the outer surface of the collar 400 and the inner surface of either upper tube 211, 212, thus reducing corrosion of the inner surfaces of the upper tubes 211, 212. In some embodiments, the flexible ring 500 may be omitted. That is, the rim 202 of the upper tube 211 or 212 may abut directly against the outer flange 402 of the corresponding collar 400 to seal the gap between the outer surface of the collar 400 and the inner surface of the corresponding upper tube 211, 212.

In some embodiments, and as shown in FIG. 5, a ring-shaped inner flange 403 of the collar 400 may be provided on an inner surface of the collar 400. The inner flange 403 may be located at an end of the collar 400 opposite to the assembled end where the outer flange 402 is located. The inner flange 403 of the collar 400 may abut against an outer surface of the connecting tube 213 to seal the gap between the collar 400 and the outer surface of the connecting tube 213, thereby constituting a second water-tight seal for preventing water from entering the interior of the upper tubes 211, 212 via the gap.

In some embodiments, the assembling ends of the first upper tube 211 and/or of the second upper tube 212 are configured as a solid tubular wall having no through-hole. Alternatively or additionally, one or more of the collars 400 may include a solid tubular wall with no through-hole. The absence of any through-holes in either or both of the collars 400 and/or the upper tubes 211, 212 may further prevent water from entering the tubes via through-holes, thus even further improving water resistance, and therefore corrosion resistance, of the support frame 200.

Although some embodiments have been described by way of example herein, various variations could be made to these embodiments without departing from the spirit of the present disclosure. All such variations belong to the conception of the present disclosure and fall within the scope of protection defined by the claims of the present disclosure. For example and without limitation, the upper tubes, the connecting tubes and the support members are not limited to being made of metal, and may be made of other suitable materials.

The specific embodiments disclosed herein are merely illustrative of the principles of the present disclosure. It would be apparent to those skilled in the art that various modifications could be made according to the teachings of the present disclosure and the present disclosure could be practiced in various equivalent ways. Thus, the particular embodiments of the present disclosure disclosed above are merely illustrative, and the scope of protection of the present disclosure is not limited by the details of the structures or designs disclosed herein, unless otherwise defined in the claims. Accordingly, various substitutions, combinations or modifications could be made to the particular exemplary embodiments disclosed above, and all variations thereof fall within the scope of the present disclosure. The frame pool exemplarily disclosed herein may also be appropriately practiced in the absence of any element not specifically disclosed herein or in the absence of optional components disclosed herein. All values and ranges disclosed herein may also be varied. Whenever a range of values with a lower limit and an upper limit is disclosed, any value falling within the range and any included range are specifically disclosed. Specifically, any range of values disclosed herein could be considered to list any value and any range included within the broader range of values. Likewise, the terms in the claims have their clear and ordinary meaning unless otherwise defined unambiguously and clearly by the applicant.

Additionally, the number of a component in the claims may be one or at least one, unless otherwise stated. If the words or terms in the present disclosure are inconsistent with those in other documents in terms of usage or meaning, the usage or meaning defined by the present disclosure shall govern.

What is claimed is:

1. A frame pool, comprising:

a pool body adapted to contain liquid therein and comprising a sleeve extending along an upper edge thereof;

a support frame adapted to support the pool body, the support frame comprising:

an upper frame extending through the sleeve and comprising:

a first upper tube, a second upper tube, a connecting tube disposed between the first upper tube and the second upper tube, the connecting tube comprising a first end, extending in a first direction substantially parallel to a length of the first upper tube, and a second end, extending in a second direction substantially parallel to a length of the second upper tube, a plurality of support members adapted to support the upper frame, and a collar surrounding one of the first end of the connecting tube and the second end of the connecting tube and disposed within the assembling end of one of the first upper tube and the second upper tube;

wherein an outer diameter of the connecting tube is less than an inner diameter of the first upper tube and the second upper tube such that the connecting tube is free to move in an axial direction throughout the first upper tube and the connecting tube is free to move in an axial direction throughout the second upper tube;

wherein the one of the first upper tube and the second upper tube comprises a protrusion protruding inward from an inner surface of the assembling end of the one of the first upper tube and the second upper tube; and wherein the collar comprising a recess on an outer surface thereof and configured to receive the protrusion therein.

2. The frame pool according to claim 1, further comprising a first water-tight seal disposed between the collar and the one of the first upper tube and the second upper tube.

3. The frame pool according to claim 2, wherein:

the first water-tight seal comprises an outer flange extending radially outward from an outer surface of an end of the collar and is configured to abut against a rim of the assembling end of the one of the first upper tube and the second upper tube.

4. The frame pool according to claim 2, further comprising a second water-tight seal disposed between the collar and the connecting tube.

5. The frame pool according to claim 4, wherein the second water-tight seal comprises an inner flange extending radially inwardly from an inner surface of the collar and is configured to abut against an outer surface of the connecting tube.

6. The frame pool according to claim 1, wherein the collar comprises a friction element extending outward from an outer surface thereof and towards the one of the first upper tube and the second upper tube.

7. The frame pool according to claim 6, wherein the friction element comprises one or more ribs extending annularly about the outer surface of the collar.

8. The frame pool according to claim 1, wherein the one of the first upper tube and the second upper tube comprises a solid tubular wall absent any through-hole in a radial direction.

9. The frame pool according to claim 1, wherein the collar comprises a solid tubular wall absent any through hole in a radial direction.

10. The frame pool according to claim 1, wherein the collar is made of plastic.

11. The frame pool according to claim 1, wherein each of the support members of the plurality of support members defines angle to a plane of the upper frame of between 45 degrees and 90 degrees.

12. The frame pool according to claim 1, wherein at least one of the first upper tube, the second upper tube, the connecting tube, and one of the support members has a cross section with one of the following shapes: circular, elliptical, athletic-track, and square.

13. The frame pool according to claim 1, wherein at least one of the first upper tube, the second upper tube, the connecting tube, and one of the support members is made of metal.

14. The frame pool according to claim 1, wherein the collar comprises a groove formed on an outer surface thereof and extending in a longitudinal direction thereof.

15. A frame pool, comprising:

a pool body adapted to contain liquid therein and comprising a sleeve extending along an upper edge thereof;

a support frame adapted to support the pool body, the support frame comprising:

an upper frame extending through the sleeve and comprising:

a first upper tube, a second upper tube, a connecting tube disposed between the first upper tube and the second upper tube, the connecting tube comprising a first end, extending in a first direction substantially parallel to a length of the first upper tube, and a second end, extending in a second direction substantially parallel to a length of the second upper tube, a plurality of support members adapted to support the upper frame, a collar surrounding one of the first end of the connecting tube and the second end of the connecting tube and disposed within the assembling end of one of the first upper tube and the second upper tube; and a first water-tight seal disposed between the collar and the one of the first upper tube and the second upper tube;

wherein an outer diameter of the connecting tube is less than an inner diameter of the first upper tube and the second upper tube such that the connecting tube is free to move in an axial direction throughout the first upper tube and the connecting tube is free to move in an axial direction throughout the second upper tube;

wherein the first water-tight seal comprises an outer flange extending radially outward from an outer surface of an end of the collar and is configured to abut against a rim of the assembling end of the one of the first upper tube and the second upper tube; and wherein the first water-tight seal further comprises a flexible ring disposed between the outer flange of the collar and the rim of the assembling end of the one of the first upper tube and the second upper tube.

* * * * *